US005443117A

United States Patent [19]

Ross

[11] Patent Number: 5,443,117

[45] Date of Patent: Aug. 22, 1995

[54] FRAC PACK FLOW SUB

[75] Inventor: Colby M. Ross, Carrollton, Tex.

[73] Assignee: Halliburton Company, Houston, Tex.

[21] Appl. No.: 192,876

[22] Filed: Feb. 7, 1994

[51] Int. Cl.[6] ..... E21B 43/04

[52] U.S. Cl. ..... 166/51; 166/278

[58] Field of Search ..... 166/51, 55, 184, 187, 166/278

[56] References Cited

U.S. PATENT DOCUMENTS

| | | | |
|---|---|---|---|
| 3,024,845 | 3/1962 | Conrad | 166/123 |
| 3,710,862 | 1/1973 | Young et al. | 166/51 X |
| 4,018,272 | 4/1977 | Brown et al. | 166/119 |
| 4,135,577 | 1/1979 | Nelson et al. | 166/241 |
| 4,180,132 | 12/1979 | Young | 166/120 |
| 4,403,654 | 9/1983 | Haynes | 166/73 |
| 4,438,811 | 3/1984 | Patel | 166/123 |
| 4,516,634 | 5/1985 | Pitts | 166/120 |
| 4,540,051 | 9/1985 | Schmuck et al. | 166/51 X |
| 4,611,658 | 9/1986 | Salerni et al. | 166/134 |
| 4,633,943 | 1/1987 | Zunkel | 166/51 |
| 4,664,188 | 5/1987 | Zunkel et al. | 166/134 |
| 4,671,354 | 6/1987 | Henderson et al. | 166/134 |
| 4,793,411 | 12/1988 | Zunkel | 166/98 |
| 4,834,175 | 5/1989 | Ross et al. | 166/120 |
| 4,842,057 | 6/1989 | Lubitz | 166/51 |
| 4,995,456 | 2/1991 | Cornette et al. | 166/51 |
| 5,103,902 | 4/1992 | Ross et al. | 166/120 |

*Primary Examiner*—Roger J. Schoeppel

*Attorney, Agent, or Firm*—Tracy W. Druce; Dennis T. Griggs

[57] ABSTRACT

Gravel slurry is pumped through the longitudinal service bore of a tubular service tool which is extended through a packer mandrel and into the seal bore of a tubular cross-over tool which is disposed in the annulus between the service tool and a well casing. Slurry flow is directed from the service bore through a cross-over flow port of the cross-over tool into the annulus between the cross-over tool and the well casing. The gravel-laden slurry is injected through casing perforations into the surrounding earth formation at a high flow rate. After the fracture operation has been completed, the slurry flow rate is reduced substantially and a gravel pack is accumulated in the annulus between the well screen and the well casing. Slurry liquid is circulated through the well screen into a return flow bore of the service tool. The slurry liquid is then conducted through a longitudinal cross-over flow passage formed through the cross-over tool into a return annulus defined between the service tool and the packer mandrel. The slurry liquid is then conducted through the annulus between the service tool and the well casing to the surface.

21 Claims, 4 Drawing Sheets

FRAC PACK FLOW SUB

FIELD OF THE INVENTION

This invention relates generally to well completion and treatment of subterranean formations, and in particular to gravel packing of wells and hydraulic fracturing of hydrocarbon bearing formations for sand control and increased production.

BACKGROUND OF THE INVENTION

In the course of treating and preparing subterranean wells for production, a well packer and one or more screens along with a service tool are run into the well on a work string, with the packer being set against a casing bore. In a gravel pack service operation, a service seal unit is mounted on the work string and is reciprocated relative to certain flow ports and sealing points within the packer bore to route service fluid through various passages. The service seal unit carries vertical and lateral cross-over circulation passages which, when aligned with ports formed in the packer, permit service fluids such as acids, polymers, aqueous gels and gravel laden liquids to be pumped through the work string and annulus between the sand screen and the perforated well casing, into the earth formation.

At the well site, the casing is perforated across the production zone to allow production fluids to enter the well bore. Primary sand screens are installed in the flow path opposite the perforations in the casing. Packers are set above and below the sand screens to seal off the annular region where production fluids are permitted to flow into the tubing. The annulus around the sand screens is packed with relatively coarse sand or gravel to reduce the amount of fine formation sand reaching the screens. The gravel is pumped down the work string in a slurry of water or gel and is spotted directly under the packer or above each sand screen. Typically, a lower telltale screen is joined to a primary sand screen by a nipple having a polished bore. The polished bore of the nipple is sealed against a wash pipe which is connected to the lower end of the service seal unit.

To assist in spotting the gravel around the lower telltale screen and around the upper primary screen, the service seal unit is set in a lower circulating position in which the tail pipe is sealed against the polished bore of the screen connection nipple. In this position, gravel is pumped through the work string and through the bore of the service seal unit into the annulus between the screen and the casing. The gravel pack is deposited as gravel accumulates in the annulus around the lower telltale screen, with the gel or water carrying liquid being circulated upwardly through the wash pipe and into the annulus between the well casing and the work string, where it is returned to the surface.

After the gravel pack has been deposited around the lower telltale screen, the service seal unit is retracted further within the polished bore of the packer to an upper circulating position in which the seal between the wash pipe and the polished bore of the screen connection nipple is opened. In this position, the slurry is pumped down the work string through the flow ports of the service seal unit into the annulus between the primary sand screens and the well casing. The coarse gravel accumulates above the lower gravel pack in the annulus between the upper screen and the perforated well casing. The water or gel is then circulated to the surface through the primary screens into the wash pipe and through the annulus above the packer between the work string and the well casing.

DESCRIPTION OF THE PRIOR ART

It is sometimes desirable to perform a formation fracturing and propping operation simultaneously with the gravel packing operation. Hydraulic fracturing of a hydrocarbon formation is sometimes necessary to increase the permeability of the earth formation adjacent the well bore. According to conventional practice, a fracture fluid such as water, oil, oil/water emulsion, gelled water or gelled oil is pumped down the work string with sufficient pressure to open multiple fractures in the surrounding earth formation. The fracture fluid may carry a suitable propping agent, such as sand or gravel, into the fractures for the purpose of holding the fractures open after the fracturing liquid has been recovered.

The success of the fracture operation is dependent on the ability to inject large volumes of hydraulic fracture fluid into the surrounding formation at a high pressure and at a high flow rate. For some hydrocarbon formations, a successful fracture and propping operation will require injection flow rates exceeding those required for gravel packing. The gravel slurry should be forced into the formation at a flow rate great enough to fracture the formation, with the gravel slurry penetrating the formation through the fractures so that the entrained gravel will prop the formation structures apart across the fracture interface, producing channels which will create highly conductive paths reaching out into the reservoir formation surrounding the well bore, and thereby increasing the reservoir permeability in the fracture region.

A limitation on the slurry flow rate which is inherent in well completion apparatus which is capable of performing gravel packing as well as fracturing, is the presence of a cross-over tool or cross-over flow conductors within the injection flow path, which includes the bore of the service string, the production bore of the packer mandrel, and the production bore of the service tool. In one conventional arrangement, a cross-over weldment is carried within the service tool bore and is interposed in the flow path between the service string and the washpipe.

In an alternative arrangement, the cross-over tool is used in combination with concentric inner and outer flow conductors above the packer. The use of concentric flow conductors imposes a substantial reduction in cross-sectional area of the primary flow path.

With conventional cross-over tools, the flow areas are relatively small and the slurry flow rates typically do not exceed eight to ten barrels per minute at a flow velocity of about 125 feet per minute. In a successful fracturing operation, however, the flow rate may vary from around 10 barrels per minute to about 60 barrels per minute or more in order to produce the desired fracture. At such high flow rates, the slurry velocity in a small bore cross-over tool would rise into the 150–200 feet per minute range.

Formation fracturing is usually performed at a flow rate which is higher than the flow rate used for gravel packing. While one pump may be sufficient for a conventional gravel pack, three or four large capacity pumping units may be required to perform a successful formation fracture. In a typical slurry packing operation, it is necessary to pump at a rate as low as 1 barrel per minute to about 10 barrels per minute. However, when performing a frac packing operation, the required pumping rate rises to 15–30 barrels per minute range or higher. The pumping rate depends on the size of the reservoir, the natural permeability of the formation and the number of perforation tunnels which have penetrated the formation.

A serious limitation on the use of small bore cross-over tools for hydraulic fracturing operations is the structural damage caused by gravel erosion of the flow conductors and the cross-over tool at the high flow velocity of the gravel slurry which must be achieved to produce a successful fracture. The high flow velocity causes destructive abrasion of the cross-over tool. The erosion damage is most severe on the weldment structure surrounding the cross-over discharge ports. As the gravel slurry flows around the corner to exit out of the tool to flow down the outside of the screens, the gravel tends to erode at the flow transition region and cut through the cross-over weldment structure, thus rendering the tool inoperable.

SUMMARY OF THE INVENTION

According to the present invention, the cross-over tool is located outside of the primary injection flow path, so that the full service bore of the service seal unit is available for slurry transport, and a reduced flow velocity may be used. That is, the cross-over flow passages carried by the cross-over tool are located outside of the primary injection flow passage provided by the service bore of the service seal tool. The cross-over tool is coupled between the packer mandrel and the well screen flow conductor and is located externally of the service tool in the annulus between the service tool mandrel and the well casing.

The cross-over tool includes a longitudinal seal bore, a radial sidewall passage defining a cross-over flow port opening into the cross-over seal bore, and a longitudinal bypass flow passage coupled in flow communication with the packer bore. The service tool has a tubular mandrel adapted for longitudinal movement through the packer mandrel and the seal bore of the cross-over tool, thereby defining a return flow annulus between the service tool mandrel and the packer mandrel. The service tool mandrel includes a service flow bore and return flow bore which are coupled in flow communication with a service port and return flow port, respectively.

Longitudinally spaced annular seals are mounted on the service tool mandrel and are co-engagable with the cross-over seal bore when the service tool is in a circulate position for directing fluid flow from the service bore through the cross-over flow port into the injection annulus between the well screen flow conductor and the well casing, and for directing fluid flow from the return flow bore through the return flow port into the cross-over bypass flow passage.

TECHNICAL ADVANTAGES OF THE INVENTION

According to this arrangement, gravel slurry may be pumped through the full bore of the service tool and into the injection annulus without flow reduction being imposed by cross-over components. The mass flow rate of slurry is increased while maintaining the flow velocity at a level which minimizes erosion of cross-over tool components by increasing the cross-sectional area of the injection flow path. The gravel slurry is conducted through flow paths which have increasingly greater cross-section areas until it is injected into the surrounding earth formation. The gravel slurry may be pumped at relatively greater flow rates, and at a safe flow velocity, with substantially all of the gravel slurry being injected into the formation during the high flow rate fracturing operation. Although the return flow area through the longitudinal cross-over flow passage and the return annulus is smaller than the injection flow path area, the return flow area is adequate for conducting the slurry liquid which circulates through the well screen during a subsequent gravel packing operation, which is carried out at a substantially reduced flow rate.

Operational features and advantages of the present invention will become apparent from the following detailed description taken with reference to the accompanying drawings which disclose, by way of example, the principles of the invention.

DETAILED DESCRIPTION OF THE PREFERRED EMBODIMENT

Figure 1:
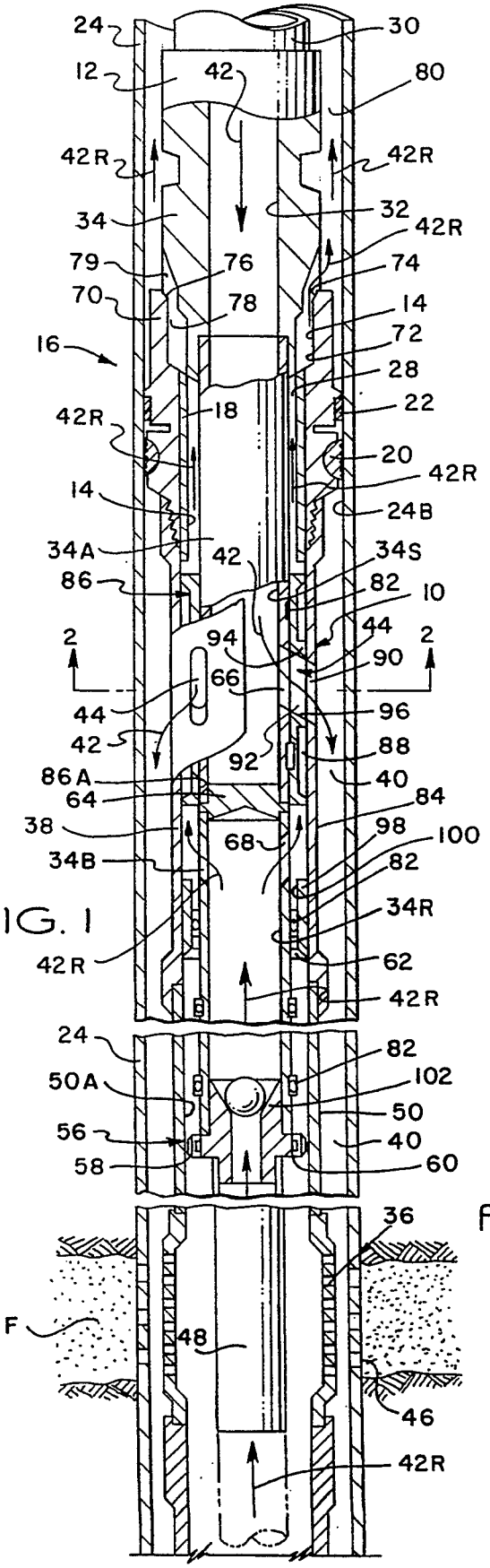
FIG. 1 is a simplified view, partially in section and elevation, showing a typical well installation with the cross-over tool in a circulating mode of operation.

In the description which follows, like parts are marked throughout the specification and drawings with the same reference numerals, respectively. The drawings are not necessarily to scale and the proportions of certain parts have been exaggerated to better illustrate details of the present invention.

Figure 3:
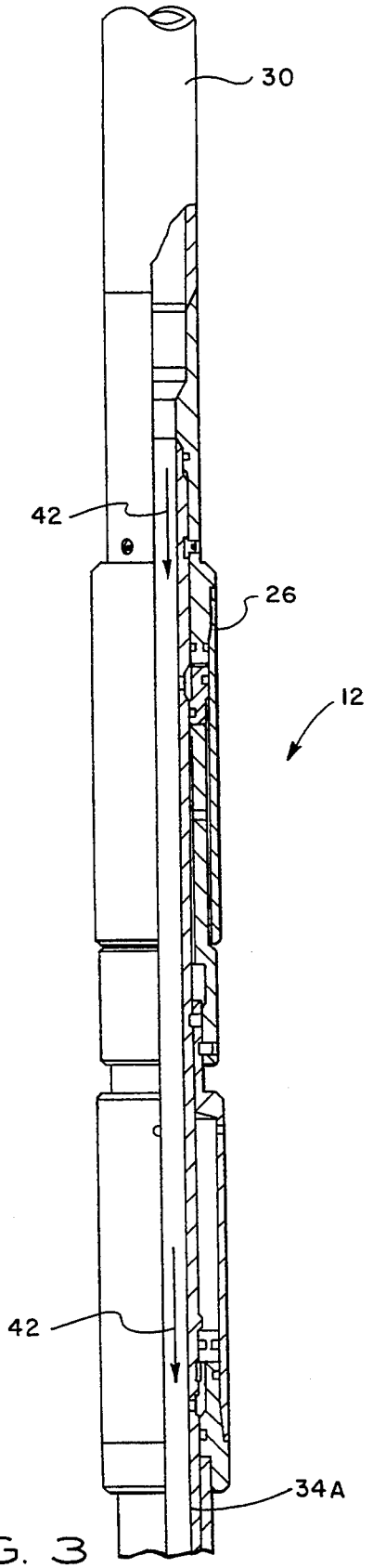
FIGS. 3 and 4 are longitudinal views, partially in section and partially in elevation, of a service seal tool landed within the bore of a hydraulically actuated production packer.
Figure 4:
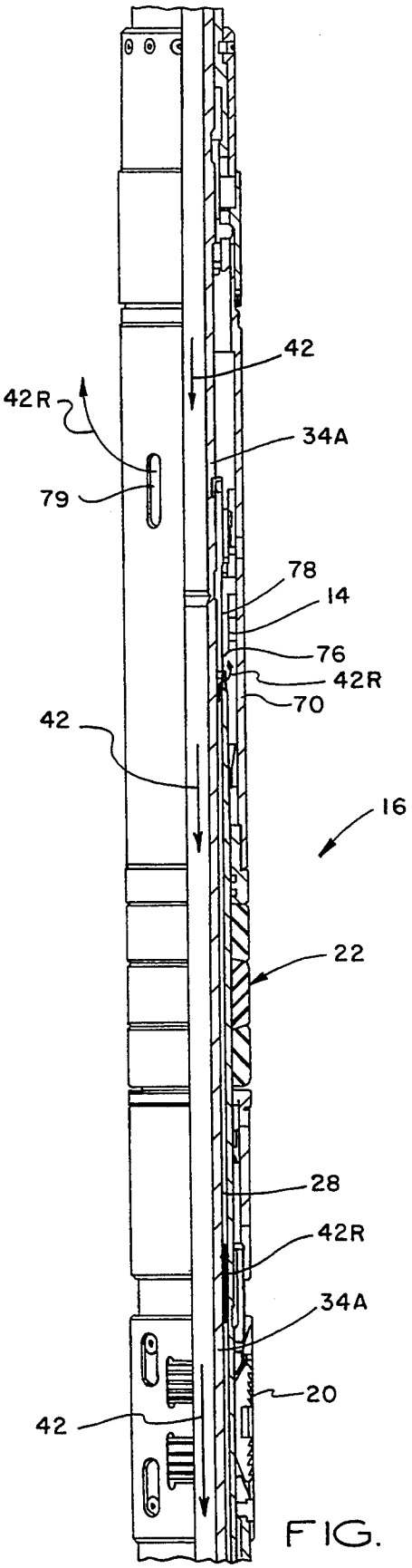
Figure 7:
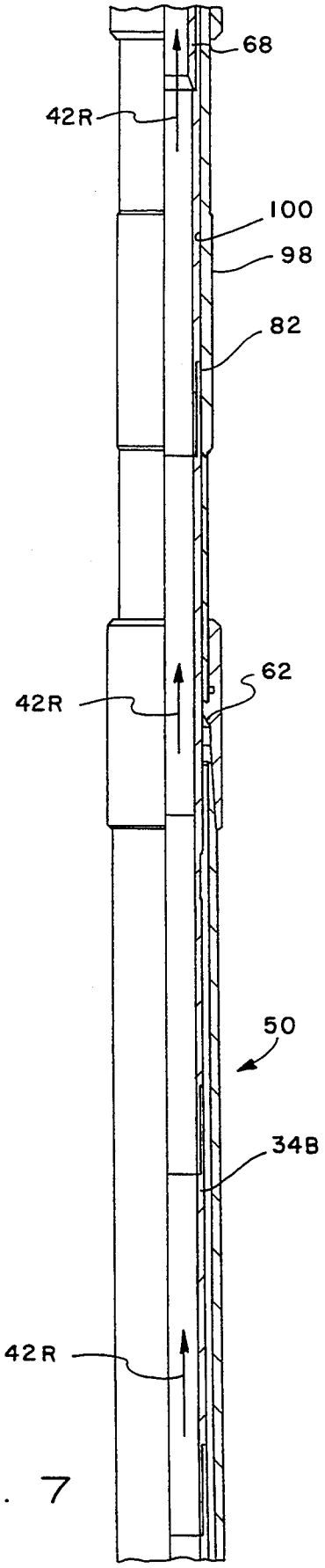

Referring now to FIG. 1, operation of the cross-over tool 10 will be explained with reference to a combination frac pack service operation in which a service seal tool 12 is landed within the polished bore 14 of a packer 16. The packer 16 has a tubular mandrel 18, anchor slips 20 and annular seal elements 22 which are extended into engagement with the casing bore 24B of a well casing 24 by a hydraulically actuated setting tool 26 (FIG. 3). The hydraulic setting tool 26 is mounted on the service tool 12 and is mechanically coupled to the anchor slips and seal elements of the packer 16. The service tool 12 is radially spaced from the packer mandrel bore 14 thereby defining a return flow annulus 28.

Gravel slurry is pumped through a work string 30 and bore 32 of a service tool locator mandrel 34. A sand screen 36 is coupled to the packer mandrel through a flow conductor 38. The annulus 40 between the casing 24 and sand screen 36 is sealed above and below a producing formation F by the expanded annular seal elements 22 carried on the packer 16 and by expanded annular seal elements carried on a sump packer (not illustrated) which is set against the well casing 24 below the producing formation F.

During a frac pack operation, slurry 42 is pumped through the work string 30 and the bore 32 of the service tool 12 through the lateral flow passages 44 of the cross-over tool 10 into the injection annulus 40. The slurry is forced through perforations 46 formed in the sidewall of the well casing 24 into the surrounding earth formation F. Coarse gravel is spotted in the annulus around the sand screen 36 as the water or gel carrier component 42R of the slurry 42 is recovered and pumped to the surface through a wash pipe 48 which is hung off of the service seal mandrel 34. The wash pipe 48 is received within the flow conductor 38 which supports the production screen 36.

During the initial run-in operation, the packer 16, cross-over tool 10, lower telltale screen, production screen 36 and the service tool 12 are run into the well on the work string 30, and the packer 16 is set and sealed against the casing bore 24B. The service seal unit 12 is attached to the packer 16 by shear pins, with the packer 16, service seal unit 12, cross-over tool 10, wash pipe 48 and screens being run in together. After the packer 16 has been engaged and set, the service tool 12 is released from the packer by moving the work string upwardly to cause shearing of the separation shear pins. The tail pipe 48 and service seal unit 12 are known to be positioned at the appropriate downhole locations to accommodate a formation fracture operation and a circulating gravel pack operation.

Mechanical stop and positive position indicating functions are provided by a snap ring assembly 56 which is connected between the service seal mandrel 34B and the wash pipe 48. The snap ring assembly includes a snap ring 58 which is coupled to a shear sleeve 60. The shear sleeve 60 is mechanically locked onto the service seal mandrel 34B by shear pins. The combined shear rating of the pins is selected to yield to a predetermined overload tension level developed in the work string 30, to permit the snap ring 58 to be released and radially retracted when it is desired to move the service tool 12 to a new operating position or to retrieve the work string and service seal unit from the well.

Figure 1B:
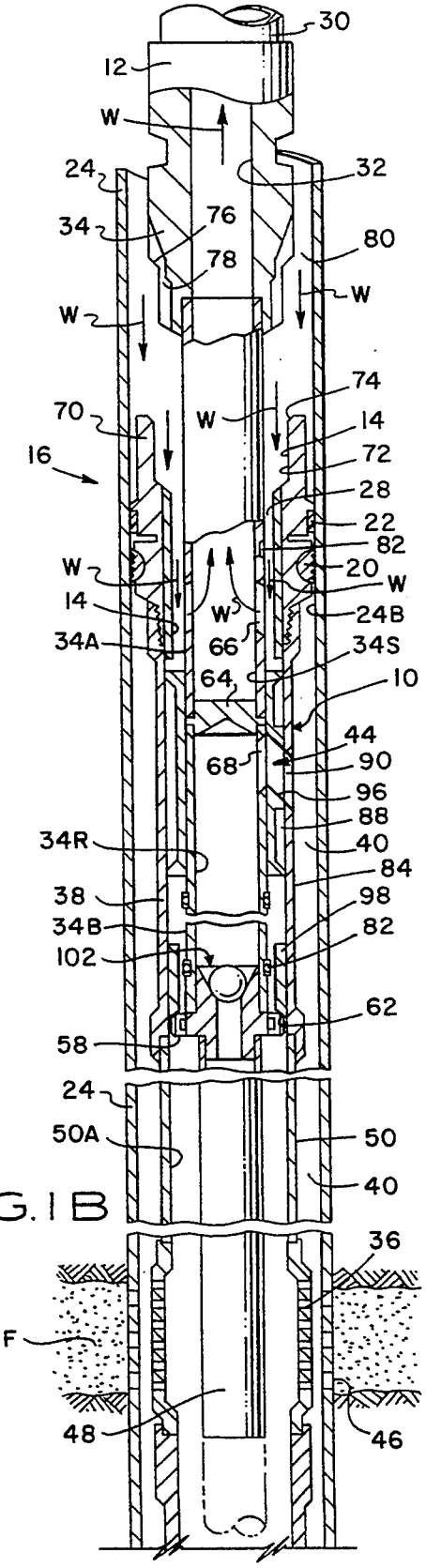
FIG. 1B is a view similar to FIG. 1, showing a typical well installation with the cross-over tool in the reverse circulate position.

The position indicating snap ring 58 is engagable against a no-go shoulder 62 mounted on the flow conductor 50. The engaged position of the positive indication snap ring 58 corresponds with a reverse circulating gravel pack operation as shown in FIG. 1B. That is, obstructing engagement of the snap ring 58 against the no-go shoulder 62 provides a positive indication that a predetermined positioning of downhole components has been achieved, and a reverse circulate gravel pack service operation may be initiated. Additionally, because the snap ring 58 is blocked in the no-go position by the high strength shear pins and shear sleeve 60, the service operations may be carried out over a wide range of work string tension levels without disturbing the desired position of the service tool, and without causing premature overload and inadvertent shear release.

The construction of the service seal tool 12 will now be described with reference to FIG. 1, FIG. 2, FIG. 5 and FIG. 6. The service seal tool mandrel 34 is an assembly of first and second tubular sections 34A, 34B which are assembled together, end-to-end by a coupling plug assembly 64. The tubular sections 34A, 34B each have a longitudinal bore defining a service flow bore 34S and a return flow bore 34R, respectively. The tubular sections are intersected by radial sidewall openings, thereby defining a service flow port 66 and a return flow port 68, respectively. The plug assembly 64 isolates the service flow bore 34S with respect to the return flow bore 34R.

The service seal tool mandrel 34 is slidably coupled to the packer by a tubular landing nipple 70 which has a shoulder 72 aligned with the packer mandrel bore 14. The tubular landing nipple 70 has an annular no-go shoulder 74 which is engageable by an annular shoulder 76 carried on the service tool locator mandrel 34, thereby limiting insertion movement of the service tool locator into the top sub bore 72. A longitudinal flow passage 78 connects the return flow annulus 28 in flow communication with the upper annulus 80 through a discharge port 79 which lies above the packer and intermediate the work string 30 and the well casing 24.

Longitudinally spaced annular seals 82 are mounted on the service tool mandrel sections 34A, 34B for directing fluid flow from the service tool into the cross-over tool passages. The annular seals 82 are co-engagable with the flow conductor bore 50A and a cross-over seal bore when the service tool is in the circulate position for directing fluid flow from the service bore 34S through a cross-over flow port passage in the cross-over tool 10 into the injection annulus 40 between the flow conductor and the well casing bore 24B. Additionally, the longitudinally spaced annular seals 82 direct fluid flow from the return flow bore 34R through the return flow port 68 through a cross-over bypass flow passage in the cross-over tool 10.

Figure 2:
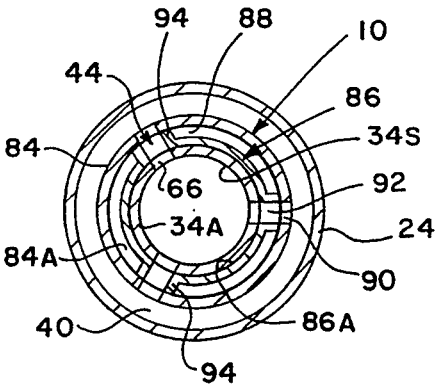
FIG. 2 is a sectional view taken along the line II—II of FIG. 1.
Figure 5:
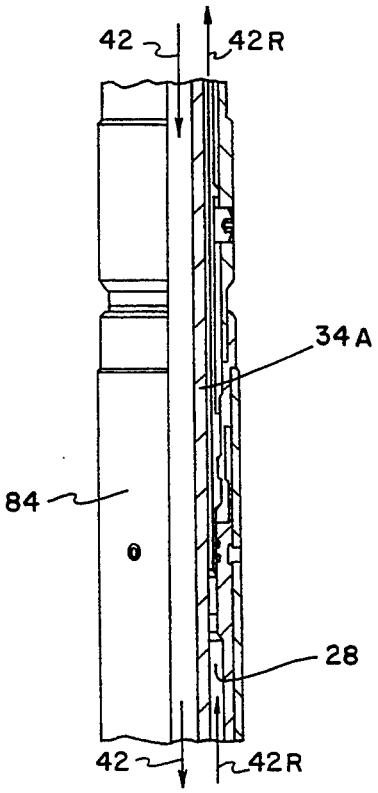
FIGS. 5 and 6 are longitudinal views, partially in elevation and partially in section, of a cross-over tool having a seal bore in which the service seal tool mandrel is received in sealing engagement; and, FIGS. 7 and 8 are longitudinal views, partially in section and partially in elevation, which illustrates the connection of the flow conductor to the cross-over tool and the connection of the washpipe to the service tool mandrel.
Figure 6:
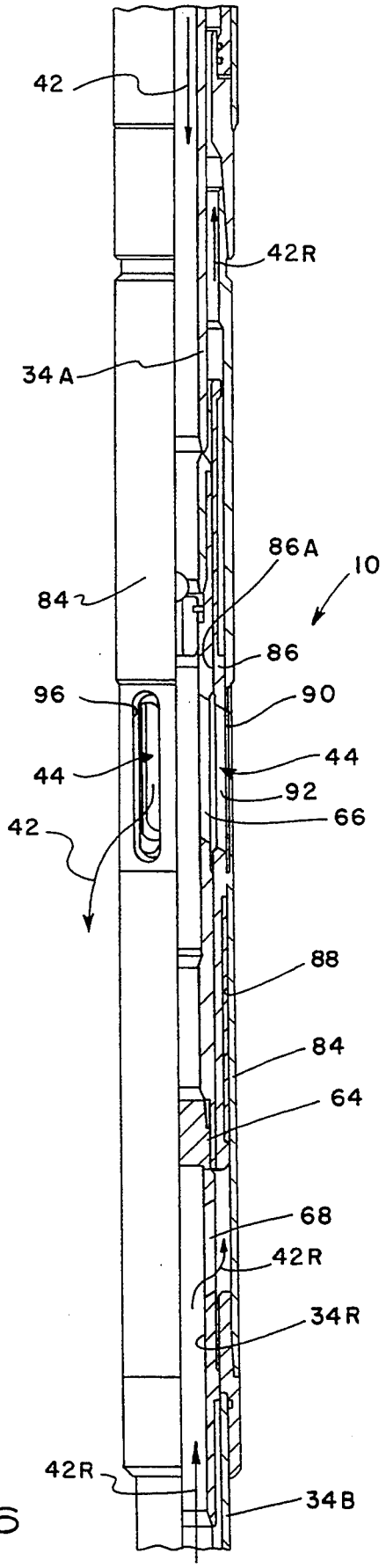

The construction of the cross-over tool 10 will now be described with reference to FIG. 1, FIG. 2 and FIG. 6. As can best be seen in FIG. 1, the cross-over tool 10 is located in the annulus between the service tool mandrel 34 and the well casing 24. The cross-over tool 10 includes a tubular housing 84 which connects the flow conductor 50 to the packer mandrel 18. The cross-over tool 10 also includes a tubular cross-over mandrel 86 disposed within and radially spaced from the bore 84A of the cross-over housing, thereby defining a longitudinally extending, cross-over bypass flow passage 88. The tubular cross-over housing 84 has a sidewall flow port and the tubular cross-over mandrel has a sidewall flow port 92 which are disposed in flow alignment with each other, as shown in FIG. 1 and FIG. 2.

The cross-over mandrel 86 includes a shoulder portion 94 bordering the sidewall flow port 92 and sealed against the cross-over housing 84 by a weldment 96. The radial shoulder portion 94 maintains the cross-over mandrel 86 radially spaced from the cross-over housing 84, thereby maintaining the bypass flow annulus open for conducting fluid flow from the return flow bore 34R into the return annulus 28.

By this arrangement, the cross-over tool 10 permits flow communication between the service bore 34S and the injection annulus 40 when the service tool sidewall flow port 66 is aligned with the cross-over flow passage 44, which is formed by the aligned sidewall passages 90, 92. The cross-over tool also permits flow communication between the return flow bore 34R of the service tool mandrel and the cross-over annulus 88 when the sidewall flow port 68 of the lower service tool mandrel 32B is disposed in flow communication with the cross-over annulus 88, as shown in FIG. 1.

The annular seal members 82 are disposed in slidable, sealing engagement against the seal bore 86A of the cross-over mandrel 86. A tubular flow conductor 98 having a seal bore 100 is coupled to the cross-over tool housing, with its seal bore 100 being disposed in flow alignment with the seal bore 86A of the cross-over tool 10. The annular seal members 82 are longitudinally spaced with respect to each other and are co-engageable with the seal bore 100 and the seal bore 86A of the cross-over mandrel when the service tool is in the circulate position for directing fluid flow from the service bore 34S through the cross-over flow port 44 into the injection annulus 40, and for directing fluid flow from the return flow bore 34R through the return flow port 68 into the cross-over bypass annulus 88. According to this arrangement, the liquid slurry 42 is constrained to flow through the aligned flow ports between the service tool mandrel and the cross-over tool when the service tool mandrel is in the circulate position. Additionally, the return flow 42R of liquid slurry is constrained to flow only through the washpipe 48 and the cross-over bypass annulus 88 into the return annulus 28 for return circulation to the surface.

The annular seals 82 are also co-engagable with the cross-over seal bore and the flow conductor seal bore 14 when the service tool is in a reverse circulate position (position indicator ring 56 engaged against the no-go shoulder 62). In the reverse circulate position, the sidewall flow port 66 of the upper service tool mandrel section 34A is positioned above the packer mandrel in flow communication with the upper annulus 80, with the cross-over flow port 44 being sealed with respect to the service flow bore 34S. The reverse circulate position is used when the fracture and gravel pack operations have been completed, and it is desired to flush the residual gravel slurry from the service tool and the service string. By shouldering up the positive indicator ring 56 on the no-go shoulder 62, the service flow port 66 on the upper service tool mandrel section 34A is positioned above the packer. This permits water W or other cleaning fluid to be pumped down the upper annulus 80 and circulated through the exposed service port 66 and return the gravel-laden fluids which are contained in the upper tubing string back to the surface.

The reverse circulate position may also be used to carry out a pickling operation in which an acid solution is pumped down through the service string tubing. The pickling operation cleans rust, scale, excess pipe dope and other debris that may be in the tubing string. Because the solution is corrosive, it is not desirable to circulate the acid slurry through the casing. After the tubing string has been filled with the acid-cleaning fluid, it is flushed out of the tubing string by reverse circulation of water down the upper annulus 80 and through the service flow port 66 into the service bore 34S, where the acid solution is flushed to the surface. The acid solution is prevented from entering the cross-over bypass annulus by sealing engagement of the annular seal members 82 against the seal bore of the cross-over tool at a location above the cross-over flow port 44.

Figure 8:
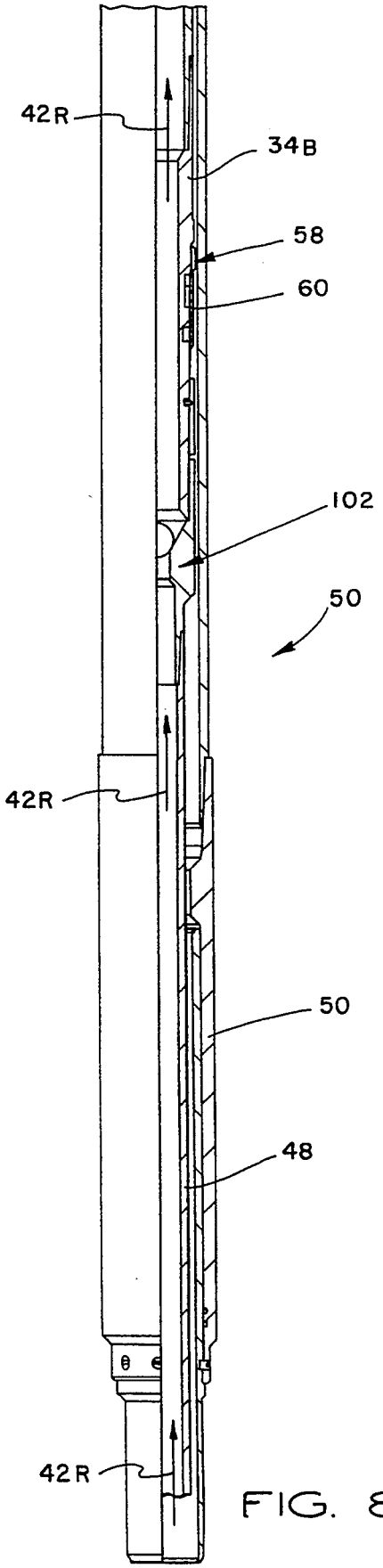

Referring again to FIG. 1 and FIG. 8, a check valve assembly 102 is coupled to the lower service tool mandrel 34B for conducting fluid flow which is conducted through the well screen 36 into the flow conductor 50, and for blocking fluid flow in the reverse direction. This check valve arrangement prevents loss of completion fluids contained within the upper annulus 80 or slurry liquid contained in the tubing that might escape through ports 66 while in the reverse position prior to reverse circulating upon termination of a fracture operation or a gravel pack operation.

Gravel slurry is pumped through the service string 30 at high flow rate into the full bore 32 of the service tool mandrel. In the squeeze position as shown in FIG. 1, the flow ports 66 of the upper service tool mandrel 34A are aligned with the radial flow ports 44 of the cross-over tool 10. Additionally, the return flow ports 68 are aligned in flow communication with the cross-over bypass annulus 88 to provide a return circulation flow path for the slurry liquid return flow 42R. Slurry 42 flow at high flow rate is directed from the service bore 34S of the service tool mandrel through the cross-over flow port 44 of the cross-over tool into the injection annulus 40 between the screen and the well casing.

The lower casing annulus below the screen fills rapidly to the level of the casing perforations 46, at which time the gravel-laden slurry is injected through the casing perforations into the surrounding earth formation F at a high flow rate, thus producing fractures in the surrounding formation. During the fracturing operation, substantially all of the slurry liquid is injected into the formation, along with the solid component of the slurry, with no liquid component being returned to the surface since the annulus is sealed off at the surface during this operation.

After the fracture operation has been completed, and the formation has been fractured to the maximum extent possible, the slurry flow 42 is temporarily terminated or reduced substantially while the annular valve is opened to provide flow communication with the screen 36. The pumping of gravel-laden slurry into the injection annulus 40 is then resumed, but at a substantially reduced flow rate. The liquid component 42R of the gravel-laden slurry is then returned through the screen 36 into the washpipe 48 where it is circulated to the surface through the return service bore 34R, the cross-over bypass annulus 88 and the return annulus 28, through the upper return flow passage 78 into the upper annulus 80 to the surface.

It will be appreciated that the foregoing arrangement in which the cross-over tool is located outside of the service tool makes the full service flow bore of the service tool available for pumping gravel slurry at the high flow rate required for a successful fracture operation. Because the full service bore of the service seal unit is available for slurry transport, the gravel slurry may be pumped at a reduced flow velocity as compared with the flow velocity required to inject a comparable volume slurry through a conventional service tool in which the cross-over tool occupies a part of the service bore flow area. Although the cross-sectional flow area of the return passages is smaller than the injection flow path area of the service tool bore, the return flow area is sufficient for handling the slurry liquid which circulates through the well screen during the gravel packing operation, since the gravel packing operation is carried out at a substantially reduced flow rate. Moreover, although the return flow passages are very thin, the thin annular space will provide a relatively large cross-sectional flow area, since it is located at a relatively large radius.

By utilizing the annular space between the service tool mandrel and the flow conductor to establish cross-over flow passages, an adequate return flow rate is obtainable during the gravel packing operation, without sacrificing the full injection bore during injection of slurry in a fracturing operation. That is, even though the return annulus is thin and has a relatively smaller return flow area, initially, a large flow area is needed only through the service tool bore during the fracturing operation, because all of the gravel and slurry liquid are injected into the formation, with none being returned to the surface. However, after the fracturing operation has been completed and the screen in packed, there is sufficient return flow area through the return annulus flow path to handle the slurry liquid which is produced during a gravel packing operation, which is carried out at a substantially reduced gravel pack flow rate.

While a particular form of the present invention has been illustrated and described, it should be apparent that variations and modifications may be made therein without departing from the spirit and scope of the invention as set forth in the appended claims.

What is claimed is:

1. Apparatus for treating a well, including a packer having a production mandrel and a longitudinal flow bore disposed within the well and a flow conductor coupled to the packer mandrel, the well treating apparatus comprising, in combination:

a cross-over tool coupled between the packer mandrel and the flow conductor, the cross-over tool having a longitudinal seal bore, a radial sidewall passage defining a flow port opening into the cross-over seal bore, and a longitudinal bypass flow passage coupled in flow communication with the packer mandrel flow bore; and, a service tool having a tubular mandrel disposed within the packer mandrel bore and the seal bore of the cross-over tool, thereby defining a return flow annulus between the service tool mandrel and the packer mandrel, the service tool mandrel having a service flow bore and a return flow bore coupled in flow communication with a service flow port and a return flow port, respectively.

2. Apparatus for treating a well as defined in claim 1, including:

mutually engageable means coupled to the packer mandrel and the service tool, respectively, for limiting longitudinal insertion movement of the service tool relative to the packer to a circulate position in which the service flow port is coupled in flow communication with the cross-over flow port and the return flow port is coupled in flow communication with the cross-over by-pass flow passage.

3. Apparatus for treating a well as defined in claim 1, including:

a tubular landing nipple coupled to the packer mandrel, the tubular landing nipple having a landing bore aligned with the packer mandrel bore and having an annular no-go shoulder;

the service tool including a tubular landing mandrel insertable into the landing bore, the landing mandrel having an annular shoulder engageable against the no-go shoulder, thereby limiting insertion movement of the service tool landing mandrel into the landing bore; and, longitudinal flow passage means connecting the return flow annulus in flow communication with the annulus between the service tool landing mandrel and the well bore when the service tool is landed within the landing nipple.

4. Apparatus for treating a well as defined in claim 1, including:

sealing means mounted on the service tool mandrel and disposed in slidable, sealing engagement with the seal bore for directing fluid flow from the service tool into the cross-over tool passages.

5. Apparatus for treating a well as defined in claim 4, the sealing means including:

longitudinally spaced annular seals mounted on the service tool mandrel, the annular seals being co-engageable with the flow conductor bore and the seal bore when the service tool is in a circulate position for directing fluid flow from the service bore through the cross-over flow port into the annulus between the flow conductor and the well bore, and for directing fluid flow from the return flow bore through the return flow port into the cross-over bypass flow passage.

6. Apparatus for treating a well as defined in claim 1, including:

mutually engageable means coupled to the cross-over tool and to the service tool, respectively, for limiting longitudinal retraction movement of the service tool relative to the packer to a reverse circulate position in which the flow passages of the cross-over tool are sealed with respect to the service bore, and the service bore is coupled in flow communication with the annulus between the service tool and the well bore.

7. Apparatus for treating a well as defined in claim 6, the mutually engageable means comprising:

a position indicting ring mounted on the service tool mandrel; and, a no-go shoulder disposed on the flow conductor for engaging the position indicating ring, thereby limiting retraction movement of the service tool relative to the packer to the reverse circulate position.

8. Apparatus for treating a well as defined in claim 1, the sealing means including:

longitudinally spaced annular seals mounted on the service tool mandrel, the annular seals being co-engageable with the seal bore when the service tool is in a reverse circulate position for preventing fluid flow from the service flow bore through the cross-over flow port, for preventing fluid flow through the cross-over bypass passage into the return flow bore.

9. Apparatus for treating a well as defined in claim 1, including a plug sealing the service flow bore and the return flow bore at a location intermediate the service flow port and the return flow port.

10. Apparatus for treating a well as defined in claim 1, including:

a check valve coupled to the service tool mandrel for conducting fluid flow from the bore of the flow conductor into the return flow bore, for blocking fluid flow in the reverse direction.

11. Apparatus for treating a well as defined in claim 1, the cross-over tool comprising:

a tubular housing connecting the flow conductor to the packer mandrel;

a tubular cross-over mandrel disposed within and radially spaced from the bore of the cross-over housing, thereby defining the longitudinal bypass flow passage, the tubular housing having a sidewall flow port and the tubular cross-over mandrel having a sidewall flow port which are disposed in flow alignment with each other; and, the cross-over mandrel having a shoulder portion bordering the sidewall flow port and sealed against the cross-over housing thereby forming the cross-over flow port.

12. Apparatus for treating a well as defined in claim 1, the service tool mandrel comprising:

first and second tubular sections each having a longitudinal bore defining the service flow bore and the return flow bore, respectively;

the first and second tubular sections being intersected by first and second radial flow ports, thereby defining the service flow port and the return flow port, respectively; and, longitudinal coupling means interconnecting the first and second tubular sections in longitudinal alignment with each other.

13. Apparatus for treating a well having a well bore intersecting an earth formation, including a packer having a production mandrel installed within the well and a flow conductor coupled to the packer mandrel, the well treating apparatus comprising, in combination:

a cross-over tool coupled between the packer mandrel and the flow conductor, the cross-over tool having a longitudinal seal bore, a radial sidewall passage defining a flow port opening into the cross-over seal bore, and a longitudinal bypass flow passage coupled in flow communication with the packer bore;

a service tool having a tubular mandrel adapted for longitudinal movement through the packer mandrel and disposed in slidable, sealing engagement with the seal bore of the cross-over tool, the service tool mandrel having a service flow bore and a return flow bore coupled in flow communication with a service flow port and a return flow port, respectively; and, the service tool mandrel being moveable relative to the packer to a circulate position in which the service flow port is coupled in flow communication with the cross-over sidewall port and the return flow port is coupled in flow communication with the cross-over bypass flow passage.

14. Apparatus for treating a well as defined in claim 13, including:

longitudinally spaced sealing means mounted on the service tool mandrel, the sealing means being co-engageable with the seal bore when the service tool is in the circulate position for directing fluid flow from the service bore through the cross-over flow port into the annulus between the flow conductor and the well bore, and for directing fluid flow from the return flow bore through the return flow port into the cross-over bypass flow passage.

15. Apparatus for injecting a liquid slurry containing gravel into the annulus between a flow conductor and a well casing comprising, in combination:

a packer having a tubular mandrel and means for sealing the annulus between the tubular mandrel and a well casing;

a tubular flow conductor coupled to the packer mandrel;

a service tool including a tubular mandrel disposed for longitudinal movement through the bore of the packer mandrel and the bore of the flow conductor, thereby defining a return flow annulus between the service tool mandrel and the packer mandrel;

the service tool mandrel having first and second longitudinally spaced sidewall flow ports, and including a plug sealing the bore of the service tool mandrel at a location intermediate the first and second sidewall flow ports, thereby defining a service flow bore and a return flow bore;

a cross-over tool coupled between the packer mandrel and the flow conductor, the cross-over tool having a longitudinal seal bore disposed in sealing engagement with the service tool mandrel, a sidewall port defining a radial flow passage between the seal bore and the annulus between the cross-over tool and the well casing, and a longitudinal sidewall passage coupled in flow communication with the return flow annulus;

the first and second sidewall flow ports of the service tool being alignable in flow communication with the cross-over sidewall port and the cross-over tool return passage, respectively, whereby gravel slurry may be pumped through the service bore of the service tool mandrel and through the cross-over sidewall port into the annulus between the flow conductor and the well casing, with the slurry liquid being returned through the return flow bore of the service tool mandrel and through the return flow port of the service tool into the longitudinal bypass flow passage of the cross-over tool through the return annulus into the annulus between the service tool and the well casing.

16. Apparatus for treating a subterranean well comprising, in combination:

a packer having a tubular mandrel and means for sealing the annulus between the tubular mandrel and a well bore;

a tubular flow conductor coupled to the packer mandrel;

a service tool having a tubular mandrel disposed for longitudinal movement within the bore of the packer mandrel and the flow conductor, thereby defining a return flow annulus between the service tool mandrel and the packer mandrel;

the service tool mandrel having first and second longitudinally spaced sidewall flow ports, and including a plug sealing the bore of the service tool mandrel at a location intermediate the first and second sidewall flow ports thereby defining a service flow bore and a return flow bore;

a cross-over tool coupled between the packer mandrel and the flow conductor, the cross-over tool having a tubular housing connecting the flow conductor to the packer mandrel and having a tubular cross-over mandrel disposed within and radially spaced from the bore of the cross-over housing, thereby defining a cross-over bypass annulus, the tubular housing having a sidewall flow port and the tubular cross-over mandrel having a sidewall flow port which are disposed in flow alignment with each other, and the cross-over mandrel having a shoulder portion bordering the sidewall flow port and sealed against the cross-over housing thereby defining a cross-over flow passage through the cross-over annulus; and, the cross-over tool permitting flow communication between the service bore and the injection annulus between the flow conductor and the well bore when the first sidewall flow port is aligned with the cross-over flow passage, and permitting flow communication between the return flow bore of the service tool mandrel and the cross-over annulus when the second sidewall flow port is disposed in flow communication with the cross-over annulus.

17. Apparatus for treating a well as defined in claim 16, including longitudinally spaced sealing means mounted on the service tool mandrel, the sealing means being co-engageable with the seal bore when the service tool is in a circulate position for directing fluid flow from the service bore through the cross-over sidewall flow port into the injection annulus between the flow conductor and the well bore, and for directing fluid flow from the return flow bore through the return flow port into the cross-over bypass flow passage.

18. A method for circulating a well treatment fluid in flow communication with an earth formation which is intersected by a well bore having a tubular casing which is perforated opposite the earth formation and having a well screen supported by a flow conductor coupled to the production mandrel of a well packer set in sealing engagement against the well casing comprising the steps:

pumping the treatment fluid through a longitudinal service flow bore of a service tool;

directing the flow of well treatment fluid through the cross-over port of a tubular cross-over tool which is interposed between the packer mandrel and the flow conductor;

flowing the well treatment fluid through the annulus between the flow conductor and the well casing;

conducting the well treatment fluid through the screen and into the flow conductor;

directing the flow of well treatment fluid from the flow conductor through a longitudinal bypass flow passage formed through the cross-over tool;

flowing the well treatment fluid conducted through the by-pass flow passage through a return annulus defined between the service tool and the packer mandrel; and, flowing the well treatment fluid conducted through the return annulus through the annulus between the service tool and the well casing to the surface.

19. A method for gravel packing a well in which a flow conductor and a well screen are coupled in flow communication with a packer mandrel which is sealed against a well casing comprising the steps:

pumping gravel slurry through the longitudinal service bore of a tubular service tool which is extended through the packer mandrel and into the seal bore of a tubular cross-over tool disposed in the annulus between the service tool and the well casing;

directing the slurry flow from the service bore through a cross-over flow port of the cross-over tool into the annulus between the cross-over tool and the well casing;

accumulating a gravel pack in the annulus between the well screen and the well casing;

returning slurry liquid through the well screen into a return flow bore passage of the service tool mandrel;

directing the flow of slurry liquid from the return bore passage through a longitudinal bypass flow passage formed through the cross-over tool; and flowing the slurry liquid conducted through the bypass flow passage through the return annulus into the annulus between the service tool and the well casing to the surface.

20. A method for fracturing an earth formation which is intersected by a well bore having a tubular casing which is perforated opposite the earth formation and thereafter gravel packing the annulus between a well screen which is suspended from a flow conductor coupled to the production mandrel of a well packer set in sealing engagement against the well casing comprising the steps:

pumping gravel laden slurry through a longitudinal service flow bore of a service tool;

directing the flow of gravel laden slurry through the cross-over port of a tubular cross-over tool which is interposed between the packer mandrel and the well flow conductor;

injecting the gravel laden slurry through the casing perforations into the surrounding earth formation;

accumulating gravel in the annulus between the well screen and the perforated well casing;

circulating slurry liquid through the well screen into a return flow bore of the service tool;

directing the flow of slurry liquid from the service tool return bore through a longitudinal cross-over flow passage formed through the cross-over tool into a return annulus defined between the service tool and the packer mandrel; and flowing the slurry liquid from the return annulus through the annulus between the service tool and the well casing to the surface.

21. A method for treating a well penetrating an earth formation having a well casing installed therein and having casing perforations opposite the earth formation, comprising the steps:

connecting a tubular cross-over tool in flow communication between a packer mandrel and a flow conductor, the cross-over tool having a longitudinal seal bore, a radial sidewall passage defining a cross-over port opening into the cross-over seal bore, and a longitudinal bypass flow passage coupled in flow communication with the packer mandrel bore;

connecting a well screen to the flow conductor;

running the assembled well packer, cross-over tool, flow conductor and screen assembly into the well and sealing the packer against the casing bore at a location above the casing perforations, with the well screen being supported in flow communication with the well casing perforations;

running a tubular service tool through the packer mandrel bore, through the seal bore of the cross-over tool, and into the flow bore of the flow conductor, thereby defining a return flow annulus between the service tool mandrel and the packer mandrel, and defining a longitudinal service flow bore and a longitudinal return flow bore in flow communication with a service flow port and a return flow port, respectively;

positioning the service flow port in flow communication with the cross-over port and positioning the return flow port in flow communication with the cross-over bypass flow passage;

pumping treatment fluid through the service bore of the service tool and discharging the treatment fluid through the cross-over port into the injection annulus between the well screen and the perforated well casing; and, flowing the treatment fluid through the well screen into the return bore, thence through the cross-over bypass flow passage, through the return annulus and into the annulus between the cross-over tool and the well casing to the surface.

* * * * *